US007322819B2

(12) United States Patent
Lyons et al.

(10) Patent No.: US 7,322,819 B2
(45) Date of Patent: Jan. 29, 2008

(54) BACKLIGHTING SYSTEM FOR A FIREPLACE

(75) Inventors: David Charles Lyons, Red Wing, MN (US); Thomas J. Bachinski, Lakeville, MN (US); Robert Samuel Waddell, Brooklyn Park, MN (US); Richard Berg, Lakeville, MN (US); Scott Stephen Jeutter, Richfield, MN (US); Kurt Matthew Schwie, Savage, MN (US)

(73) Assignee: HNI Technologies Inc., Muscatine, IA (US)

( * ) Notice: Subject to any disclaimer, the term of this patent is extended or adjusted under 35 U.S.C. 154(b) by 269 days.

(21) Appl. No.: 10/718,037

(22) Filed: Nov. 19, 2003

(65) Prior Publication Data

US 2004/0173202 A1 Sep. 9, 2004

Related U.S. Application Data

(60) Provisional application No. 60/453,019, filed on Mar. 6, 2003.

(51) Int. Cl.
*G09F 19/12* (2006.01)
*F24C 3/04* (2006.01)

(52) U.S. Cl. ..... 431/125; 126/512; 126/500; 40/428; 362/92; 362/93

(58) Field of Classification Search ..... 126/500, 126/502, 512, 39 BA; 431/125, 126; 40/428; 362/92, 312, 806, 93, 125, 126, 133, 20, 362/127, 458; 446/480, 481; 392/348
See application file for complete search history.

(56) References Cited

U.S. PATENT DOCUMENTS

| | | | | | |
|---|---|---|---|---|---|
| 1,010,101 | A | * | 11/1911 | Weaver | 40/428 |
| 1,768,284 | A | * | 6/1930 | Berry | 40/428 |
| 2,302,796 | A | * | 11/1942 | Oyster | 126/92 R |
| 2,445,250 | A | * | 7/1948 | Steingruber | 392/376 |
| 4,253,045 | A | | 2/1981 | Weber | |
| 4,272,908 | A | * | 6/1981 | Bassetti et al. | 446/480 |
| 4,890,600 | A | * | 1/1990 | Meyers | 126/512 |
| 6,053,165 | A | * | 4/2000 | Butler et al. | 126/512 |

(Continued)

FOREIGN PATENT DOCUMENTS

CA 2262338 * 8/2000

(Continued)

OTHER PUBLICATIONS

Co-pending U.S. Appl. No. 10/718,053, entitled "Reduced Clearance Gas Fireplace," filed Nov. 19, 2003.

*Primary Examiner*—Carl D. Price
(74) *Attorney, Agent, or Firm*—Faegre & Benson LLP

(57) ABSTRACT

A fireplace including a backlighting system. The backlighting system can be positioned in a back portion of the bottom panel of the fireplace. The backlighting system includes at least one light source to shine light upon the components of the fireplace. For example, the light source can be positioned to shine light on a back panel of the fireplace. The light source of the backlighting system can be modulated depending on a state of the fireplace. For example, the light source can be turned on or off depending on whether the flame of the fireplace is on or off.

23 Claims, 8 Drawing Sheets

U.S. PATENT DOCUMENTS

| | | | | |
|---|---|---|---|---|
| 6,385,881 | B1 | 5/2002 | Hess | |
| 2003/0049575 | A1 | 3/2003 | Lyons et al. | |
| 2003/0072159 | A1 | 4/2003 | Casey | |
| 2004/0255931 | A1* | 12/2004 | Bachinski et al. | 126/512 |

FOREIGN PATENT DOCUMENTS

| | | | |
|---|---|---|---|
| CA | 2385446 | * | 9/2002 |
| GB | 1360799 | * | 7/1974 |
| GB | 2081885 | * | 2/1982 |
| GB | 2147995 | * | 5/1985 |
| GB | 2149090 | * | 6/1985 |
| GB | 2156968 | * | 10/1985 |
| GB | 2157417 | * | 10/1985 |
| GB | 2165935 | * | 4/1986 |
| GB | 2169700 | * | 7/1986 |
| GB | 2217832 | * | 11/1989 |
| GB | 2261942 | * | 6/1993 |
| JP | 03-87524 | * | 4/1991 |

* cited by examiner

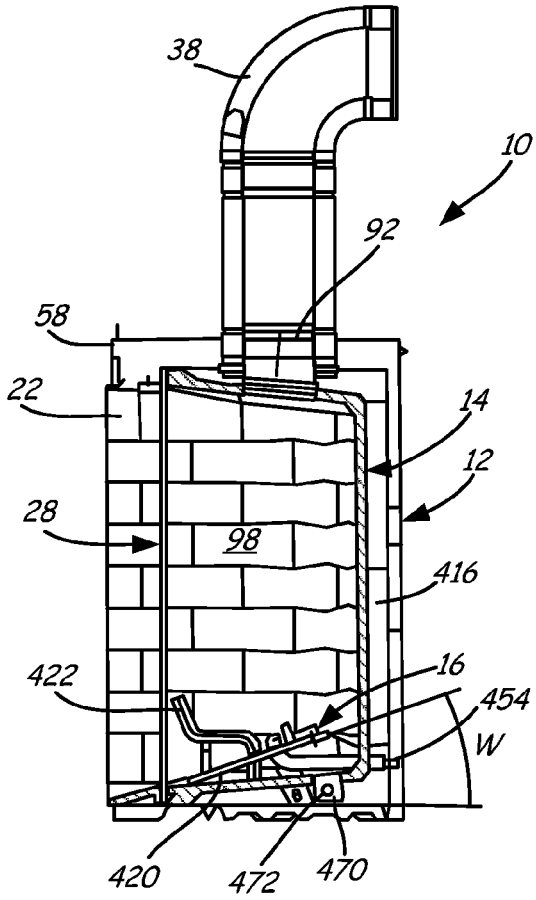
FIG. 8
FIG. 9
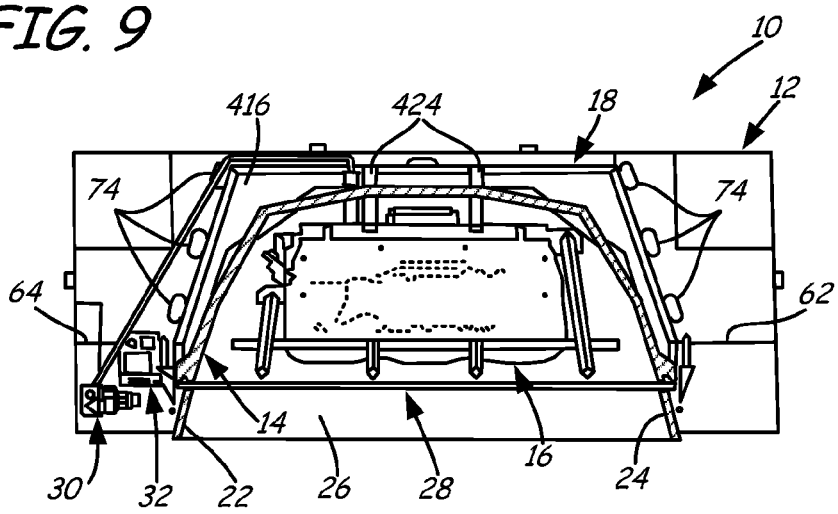

BACKLIGHTING SYSTEM FOR A FIREPLACE

RELATED APPLICATION

This application claims the benefit of U.S. Patent Provisional Application Ser. No. 60/453,019, filed Mar. 6, 2003 and entitled "Backlighting System for a Fireplace," the entirety of which is hereby incorporated by reference.

TECHNICAL FIELD

The present invention relates to fireplaces. More particularly, the invention relates to backlighting systems for fireplaces.

BACKGROUND

Gas, electric, and wood burning fireplaces are an efficient method for providing warmth and creating the appeal of a fire within a room. Fireplaces have become commonplace in today's building trades for both residential and commercial applications. Most new home construction designs include at least one, and often several fireplaces. Further, a significant number of remodeling projects are focused on fireplaces.

The representation of the glow and look in gas and electric fireplaces is desirable to simulate the effect created by a natural fire. Another concern is providing an appealing view of the fireplace contents when gas and electric fireplaces are not simulating the flame of a natural fire.

A lighting system for a fireplace provides light inside the fireplace to, for example, enhance the aesthetic appeal of the fireplace. Previous lighting systems provide only limited functionality and may detract from the appearance of a fireplace. For example, components of some lighting systems may not provide an appealing look for a fireplace.

It is therefore desirable to provide improved lighting systems for fireplaces.

SUMMARY

Generally, the present invention relates to fireplaces. More particularly, the invention relates to systems and methods for backlighting fireplaces and fireplace components.

In accordance with example embodiments of the invention, a fireplace including a backlighting system is provided. The backlighting system can be positioned in a back portion of a bottom panel of the fireplace, although other positions are also possible. The backlighting system includes at least one light source to shine light upon the components of the fireplace. For example, the light source can be positioned to shine light on a back panel of the fireplace. The light source of the backlighting system can be modulated depending on, for example, a state of the fireplace. For example, the light source can be turned on or off depending on whether the flame of the fireplace is on or off.

One aspect of the invention relates to a fireplace including an enclosure defining a combustion chamber, and a backlighting system positioned at a back portion of the enclosure and including at least one light source to shine light upon components of the fireplace.

Another aspect of the invention relates to a fireplace including an enclosure defining a combustion chamber and an open front, the enclosure including at least a lower panel and a back panel, and a burner positioned adjacent to the lower panel. The fireplace also includes a log set positioned adjacent to the burner, and a backlighting system positioned between the log set and the back panel of the enclosure, the system including a light source to shine light upon components of the fireplace including at least the back panel.

Yet another aspect of the invention relates to a method of providing backlighting for a fireplace, including: providing an enclosure defining a combustion chamber and an open front, the enclosure including at least a lower panel and a back panel, providing a log set positioned in the enclosure, positioning a backlighting system including a light source in a back portion of the enclosure behind the log set, and shining light from the light source onto the back panel of the enclosure.

The above summary of the present invention is not intended to describe each disclosed embodiment or every implementation of the present invention. Figures in the detailed description that follow more particularly exemplify embodiments of the invention. While certain embodiments will be illustrated and described, the invention is not limited to use in such embodiments.

BRIEF DESCRIPTION OF THE DRAWINGS

The invention may be more completely understood in consideration of the following detailed description of various embodiments of the invention in connection with the accompanying drawings, in which:

FIG. 8 is a cross-sectional view of the fireplace shown in FIG. 3 taken along cross-sectional indicators 8-8;

FIG. 9 is a cross-sectional view of the fireplace shown in FIG. 3 taken along cross-sectional indicators 9-9.

While the invention is amenable to various alternative embodiments, specifics thereof have been shown by way of example, and the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENTS

The invention is applicable to fireplaces. In particular, the invention is directed to an apparatus for backlighting fireplaces and fireplace components. Further, the invention is directed to utilizing backlighting to increase the natural look of the flames. While the present invention is not so limited, an appreciation of the various aspects of the invention will be gained through a discussion of the examples provided below.

Embodiments of the present invention may be used in conjunction with any system or apparatus that ignites a combustible gas to generate a flame, any electric fireplace, or any device that simulates a fire. While the example embodiments of the present invention provided below are described in conjunction with a fireplace, the present invention is equally applicable to other systems or apparatuses besides a fireplace that ignite a combustible gas to generate a gas flame.

As used herein, the term "coupled" means any structure or method that may be used to provide connectivity between two or more elements, which may or may not include a direct physical connection between the elements. The phrase "combustion chamber enclosure" may include any enclosure in which flames and/or heat are generated or simulated.

Figure 1:
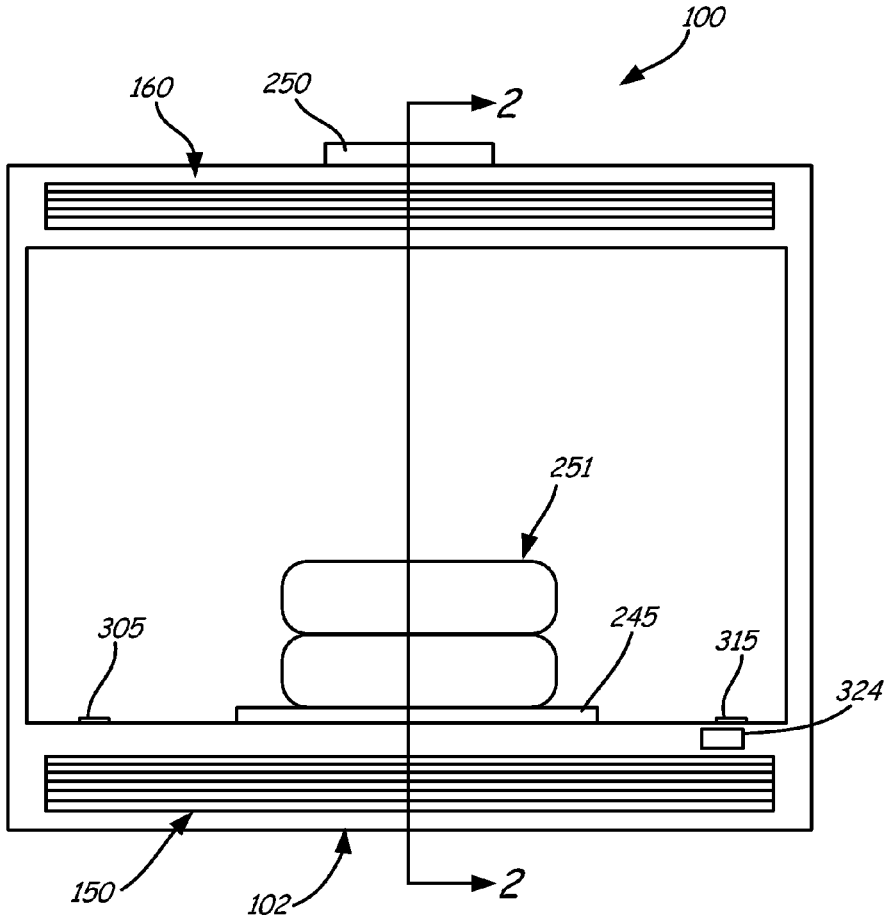
FIG. 1 is a front plan view of an example fireplace including a first example embodiment of a backlighting system made in accordance with the present invention.
Figure 2:
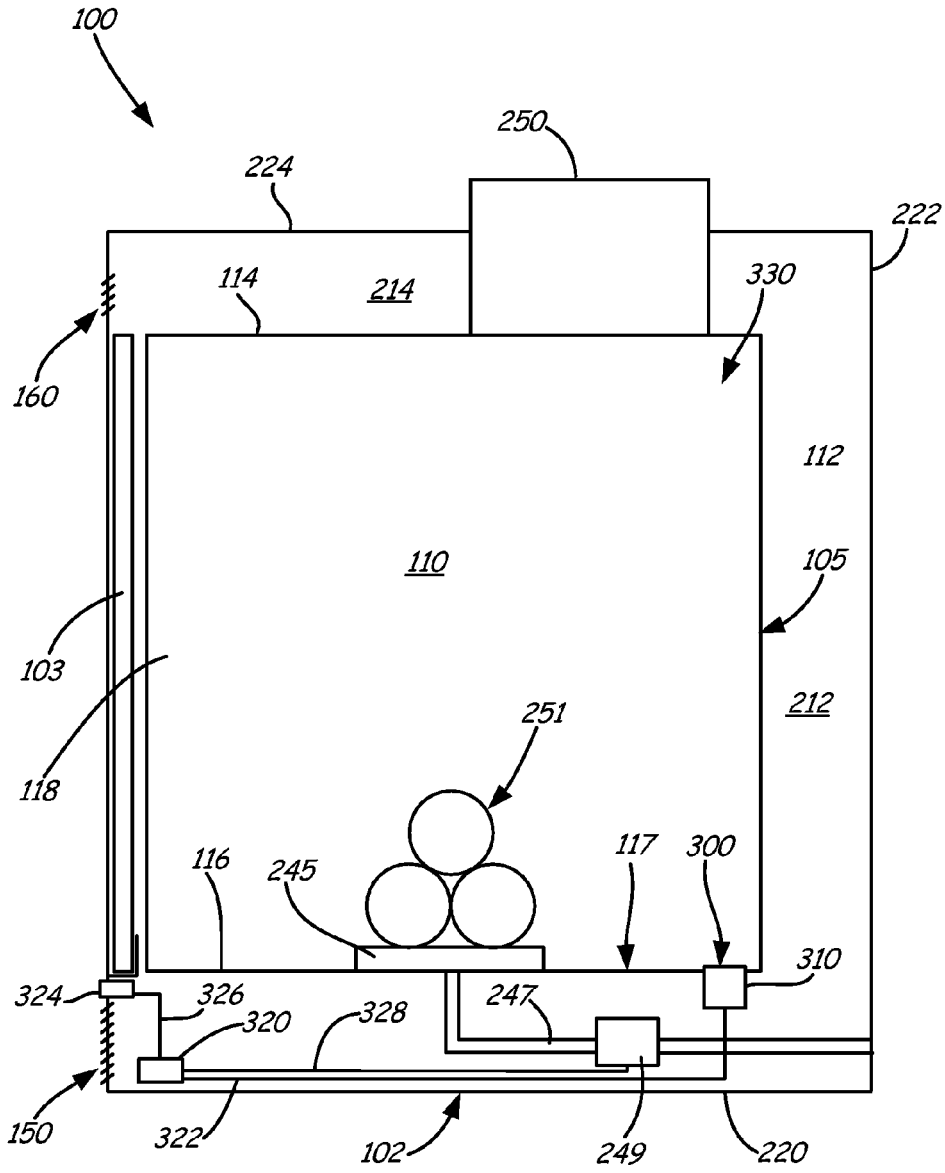
FIG. 2 is a cross-sectional view of the fireplace shown in FIG. 1 taken along cross-sectional indicators 2-2.

Referring to FIGS. 1 and 2, front and cross-sectional views of an example embodiment of a fireplace 100 are shown. Fireplace 100 is illustrated as including an outer enclosure 102, a front panel 103, grills 150 and 160, and a combustion chamber enclosure 105. The combustion chamber enclosure 105 comprises front panel 103 and panels 112, 114, 116, and 118 that together with a second side panel (not shown) define a combustion chamber 110. Preferably, the front panel 103 is transparent to allow viewing of the components disposed within the combustion chamber 110.

The fireplace 100 generally functions to ignite combustible gas provided from a combustible gas source to create a gas flame. Alternatively, a simulated electric fireplace may be constructed within the outer enclosure 102. The simulated electric fireplace can include several electrical components such as a simulated ember bed, lights, fans, blowers, and motors.

Referring again to FIGS. 1 and 2, grills 150 and 160 of fireplace 100 cover a room air intake and room air exhaust, respectively. Fireplace 100 includes a lower plenum 210, a rear plenum 212, and a top plenum 214 positioned between outer panels 220, 222, and 224 and the combustion chamber enclosure 105. The plenums 210, 212, and 214 are fluidly connected to one another and define a plenum system through which room air may enter the lower plenum 210 through the grill 150, circulate through the rear and top plenums 212 and 214, and exit through the grill 160 back into the room. The room air may be heated as it travels through the plenum system. Optionally, a blower can be used for blowing room air through the plenum system of the fireplace 100.

FIGS. 1 and 2 show fireplace 100 in one configuration. Other configurations are also possible. For example, the present invention may be applicable to any prefabricated gas fireplace, such as a direct vent, a universal vent, a B-vent, a horizontal/vertical-vent, a dual direct vent, or a multisided unit. The present invention may also be applicable to other combustible gas fireplace systems, as noted above, as well as any other fireplace that generates heat, such as a simulated electric fireplace or solid fuel burning fireplace.

A burner 245 is shown positioned in the combustion chamber enclosure 105 to combust gas and thereby generate heat. Alternatively, the burner can be positioned so that its top surface is even with or positioned below panel 116. The burner 245 is coupled by a gas line 247 to a source of combustible gas (not shown). A gas valve 249 that can be opened and closed to regulate or modulate the flow of combustible gas and either turn the combustion within the fireplace 100 on or off can be couple to the gas line 247. A log set 251 is positioned above the burner 245. The log set 251 can include one on more simulated logs that can be formed from, for example, ceramic fibers for a gas fireplace, or plastic for an electric fireplace.

An exhaust 250 exhausts combusted air from the combustion chamber enclosure 105 to the outside.

The fireplace 100 further includes a backlighting system 300 that can be utilized during simulation of a fire or when the simulation of the fire is not desired. In the illustrated embodiment, the backlighting system 300 includes three individual light sources 305, 310, and 315 that are positioned in a back portion 117 of the bottom panel 116 of the fireplace. Alternatively, one, two, or more than three individual light sources can be utilized with the backlighting system 300.

Halogen bulbs and ceramic sockets are preferably used to create the light sources 305, 310, and 315. These items can withstand the potentially high temperature environment of the fireplace that may exceed 600 degrees Fahrenheit. Any other suitable light source that can withstand high temperatures may also be used. If the light source such as light source 310 is constructed to withstand the high temperatures found in a fireplace, it is not necessary to seal-off the light source from the heat generated in the combustion chamber or to provide other methods to cool the light source. Optionally, the lens of the light source can include ceramic glass to withstand the high temperatures of a gas fireplace combustion chamber.

As shown in FIG. 2, light sources 305, 310, and 315 are coupled to a control system 320 through a first wire 322. The control system 320 can be connected directly to a power supply to provide power to the light sources 305, 310, and 315. The control system 320 can include a transformer that converts the 110 volt AC power to 12 volt DC/2 amp power that can be used to power the light sources 305, 310, and 315. Alternatively, power can be provided to the light source directly from another power supply such as a standard wall outlet. Also, the transformer can be located separate from the control system. Optionally, the backlighting system can include a battery, which can be housed within the control system 320 or at some other location, to provide power to the light sources 305, 310, and 315 and/or control system 320 during a power outage.

The control system 320 can control the operation of the light sources 305, 310, and 315 of the backlighting system 300. One method of control includes turning the light source on and off in response to a state of the fireplace. For example, if the control system 320 senses that the fireplace is no longer simulating a fire within the combustion chamber (i.e., an off state), it can then turn the light sources 305, 310, and 315 of the backlighting system 300 on to generate backlighting. Similarly, if the control system 320 senses that the fireplace 100 is simulating a fire within the combustion chamber 110 (i.e., an on state), it can then turn the light sources 305, 310, and 315 off. In some embodiments, it may be desired to continue to generate backlighting when the fireplace 100 is simulating a fire within the combustion chamber 110, or to synchronize flame modulation with backlighting modulation.

Optionally, control system 320 can be utilized to modulate the light generated at the light sources 305, 310, and 315. This modulation can occur in response to a condition or state of the fireplace or be a programmed modulation. For example, the control system can be configured control each of the individual light sources 305, 310, and 315 to varying the intensity of the individual light sources 305, 310, and 315 in a pattern.

Optionally, the control system 320 can be coupled to a photocell 324 through a second wire 326. Alternatively, the photocell 324 can be coupled to the control system 320 through a remote or wireless connection or be contained with the control system. The photocell 324 can sense the intensity (input) of light generated by the simulated fire, the light generated with the room, or both. The control system 320 can control the light sources 305,310, and 315 based upon the input at the photocell 324. For example, if the photocell 324 senses the intensity of light within the room is low, the control system 320 can turn the light sources 305, 310, and 315 on. In another embodiment, the photocell 324 can sense the intensity of the light generated by the simulated fire and modulate the light emanating from the light sources 305, 310, and 315 in response to the intensity.

Alternatively, the control system 320 can be eliminated and the light sources 305, 310, and 315 can be connected to a switch that allows the user to manually turn the backlighting system on and off as desired.

In another alternative embodiment, the control system 320 can include or be coupled to a motion detector to detect when a user enters the room and thereupon turn on the backlighting system 300. For example, the control system 320 can be configured to turn off the backlighting system 300 after a period of time during which no motion is sensed, and then to turn back on the backlighting system 300 once motion is sensed.

In another alternative embodiment, the control system 320 can be configured to measure a temperature of the fireplace, such as the front surface of the fireplace. The control system 320 can then modulate the intensity of the light produced by the backlighting system 300 based on the measured temperature. For example, the intensity of the light can be increased as the temperature increases, thereby providing an indication as to the temperature of the fireplace. This can be useful, for example, as an indication that the fireplace remains hot after the visible signs of combustion such as, for example, a flame, have ceased.

Control system 320 can be connected to another part of the fireplace to drive a relay that, for example, modulates the flow of fireplace gas through the gas valve 249. The output of the control system 320 can be coupled to control the gas valve 249 through a third wire 328, or alternatively, through a remote or wireless connection that does not include a wired connection. Optionally, the control system 320 can modulate the flame height through control of the gas valve 249. The modulation of the flame height can be coupled to modulation of the light emanating from light sources 305, 310, and 315. Alternatively, the control circuit can be used to drive other components or features of the fireplace such as, for example, increasing or decreasing gas flame height, altering the speed of a blower or fan, turning a simulated ember bed of a fireplace on and off, and controlling motors or lights in an electric fireplace.

In another alternative embodiment, one or more of the light sources 305, 310, and 315 can be colored to create desired effects. For example, a light source may include colored glass or a film placed over the light source, so that light generated by the light source is projected as one or more colors.

Light generated from the backlighting system 300 can create a silhouette effect, for example, on the log set 251. Light can also generate aesthetic lighting upon, for example, rear panel 112 or a back portion 330 of one or more side panels such as side panel 118. The light created by backlighting system 300 is preferably viewable by a fireplace user.

Further, it can be preferable to position the backlighting system 300 in a back portion of the combustion chamber enclosure 105 and/or behind the log set 251 as shown in FIGS. 1 and 2 so that, while the light from the system 300 is visible, the components of the system 300 are not visible to the user. However, in alternative embodiments, light sources of the backlighting system 300 can also be positioned at a front portion of the enclosure 105 (e.g., in one or more of panels 112, 114, 116, and 118) to create desired lighting effects.

Referring now to FIGS. 3-10, another example embodiment of a fireplace assembly 10 is shown.

Figure 3:
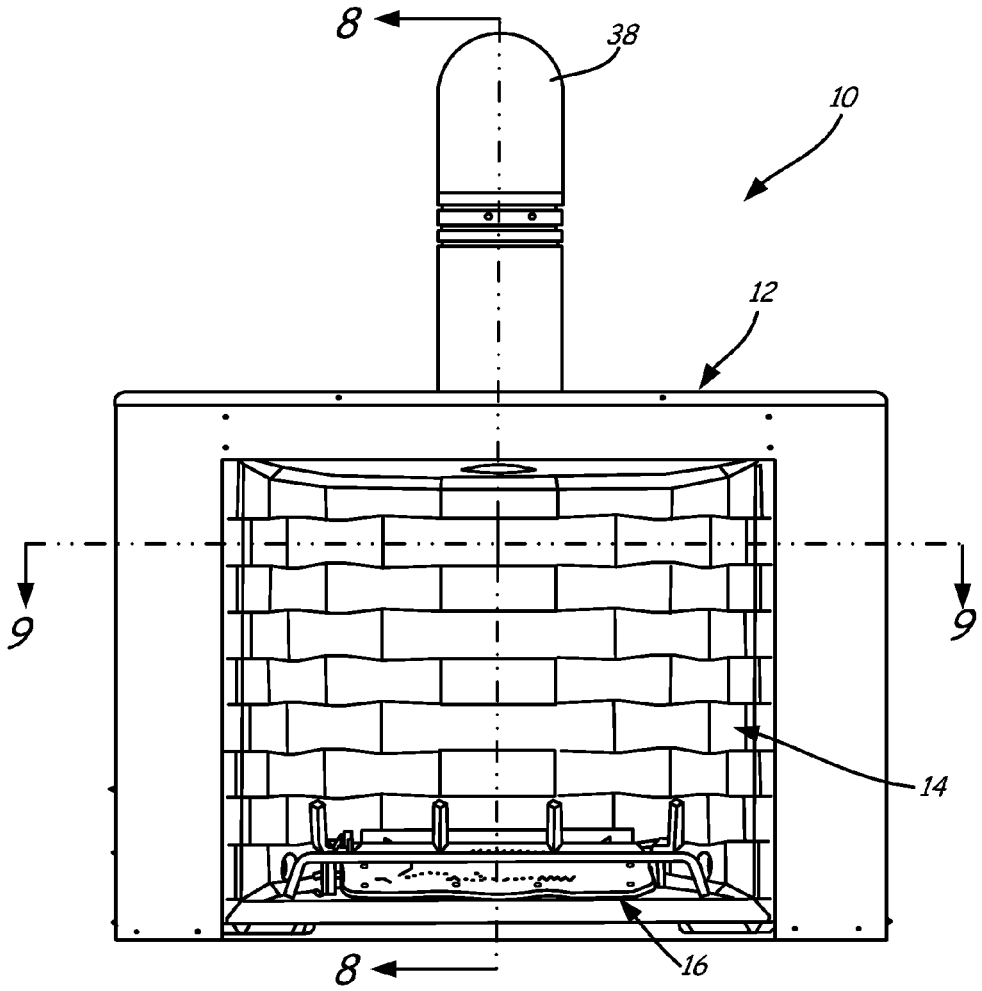
FIG. 3 is a front plan view of another example fireplace made in accordance with the present invention.
Figure 4:
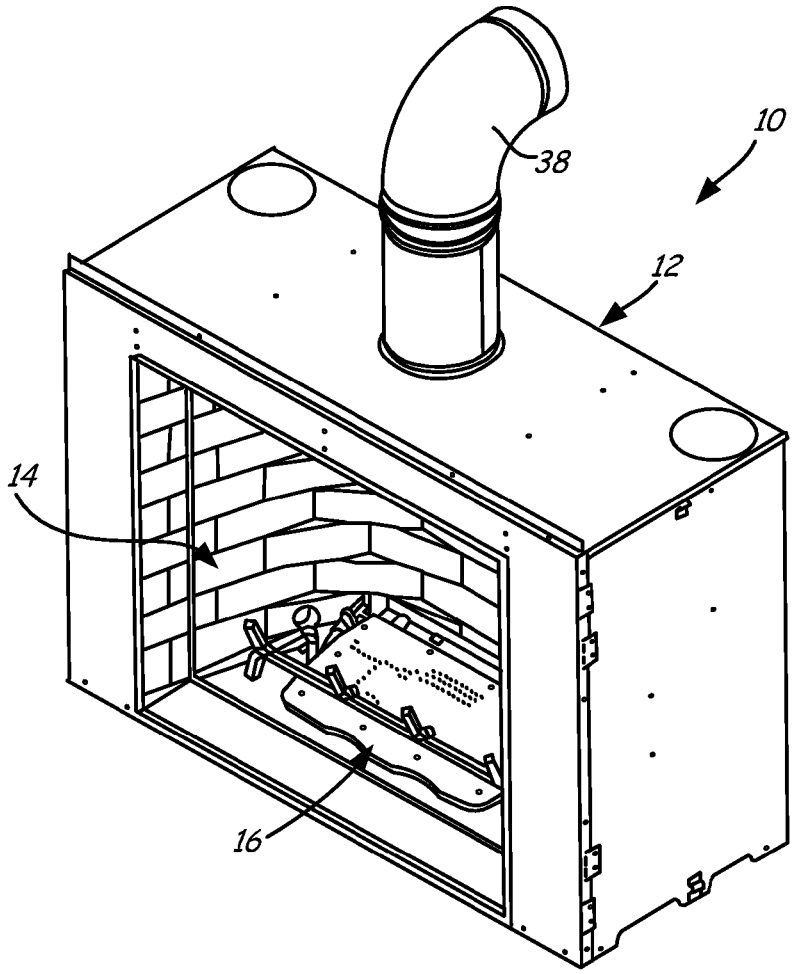
FIG. 4 a front perspective view of the fireplace shown in FIG. 3.

Referring first to FIGS. 3 and 4, fireplace assembly 10 includes an outer enclosure 12, a combustion chamber enclosure 14, a burner plate assembly 16 and a direct vent duct 38. Fireplace assembly 10 includes a large viewing area and the bottom surface of the combustion chamber enclosure 14 has little clearance underneath it so as to be substantially flush with a bottom surface of the outer enclosure 12. In fact, the space shown underneath the bottom panel of the combustion chamber enclosure 14 is raised slightly so that it is substantially flush with the hearth that is typically built up just in front of the fireplace assembly when mounted in a structure such as a home. It may be further noticed that fireplace assembly 10 does not give the appearance of having a framed piece of glass covering the fireplace opening because no glass frame is visible. These and other advantages of the present invention will be described in further detail below.

Referring now to FIGS. 5-9, fireplace assembly 10 further includes a combustion air enclosure 18, removable panels 20, 22, 26, a glass panel 28, a gas valve assembly 30, a control unit assembly 32, a light assembly 34, and a hanging wire mesh 36.

Outer enclosure 12 includes a plurality of panels secured together to form a box-like structure sized to receive and/or mount the features listed above. The panels of outer enclosure 12 include a top panel 50, a bottom panel 52, first and second side panels 54, 56, a front panel 58 and a rear panel 60. These panels may be secured together by any of a variety of methods including, for example, welding, using fasteners, or formed using such techniques as bending or stamping several panels from a single piece of material. Outer enclosure 12 may also include convection air outlets 66, 68 that allow air that has been heated within the outer enclosure to exit out from the outer enclosure 12, for example, using a pump or fan and then directing the heated air to and air space to be heated or to a furnace ducting system.

Outer enclosure 12 also includes a vent outlet 70 for receiving the exhaust duct 38 through the top panel 50. The side and rear panels 54, 56, 60 may include air escapes 72 around a bottom edge of the panel and bottom panel 52 may include air escapes 74 into the space within the outer enclosure 12 adjacent to the firebox 40 to facilitate air flow out from under the bottom panel 52 to reduce heat buildup underneath the outer enclosure 12.

The front panel 58 is preferably configured for mounting a decorative covering such as, for example, a fireplace surround, brick, stone, or tile, after the fireplace assembly 10 is installed.

Outer enclosure 12 may also include combustion air enclosure supports 62, 64 secured to the first and second side panels 54, 56. The supports 62, 64 may be coupled to side panels (discussed below) of the combustion air enclosure 18 to stabilize the firebox 40 (see FIG. 10 described below) during transport and use of fireplace assembly 10. Supports 62, 64 may be supplemented with additional supports (not shown) and may be positioned at different locations within outer enclosure 12 to optimize support and stability of firebox 40 within outer enclosure 12.

Combustion chamber enclosure 14 includes a top panel 80, a bottom panel 82, and a continuous side panel 84 that extends around the sides and rear portion of the combustion chamber enclosure 14 forming a vertical back wall thereof.

This particular example combustion air enclosure 18 includes a brick design formed in the continuous side panel 84 having the appearance of firebrick with grout lines. The brick design includes a plurality of ledges 86 that are exposed due to the offset nature of the bricks in the transition area between the sidewalls and rear walls of the combustion chamber enclosure 14. This type of brick design eliminates back corners of the combustion chamber enclosure, but is not so rounded as to give the appearance of a semi-circular combustion chamber enclosure. To maintain the appearance of distinct side and rear walls of the combustion chamber enclosure, there is at least one full brick laying flat (not offset) on each of the side walls and rear wall of the continuous side panel 84.

The plurality of ledges 86 formed by the brick design in continuous side panel 84 generally forms a lattice structure, as described further below.

In other embodiments, different sized brick and arrangements of the brick may be used to provide a different look and feel within the combustion chamber enclosure. In other examples, different designs may be used, such as, for example, a river rock or a stone design.

The brick design of combustion chamber enclosure 14 may be formed using, for example, a molding process that requires a ceramic material (such as moldable ceramic or a ceramic fiber) with a binder (see U.S. Patent Published Application No. U.S.-2003-0049575-A1, which is incorporated herein by reference), or a stamping or other forming method for shaping a metal sheet. An advantage of using a molding process is that the various panels of the combustion chamber enclosure 14 may be formed in a single step (for example using an injection, compression or vacuum molding process) and the shape and size of the brick design (or other design within the combustion chamber enclosure) may be formed with accuracy and precision for every product produced from a given mold. Using a steel product that is stamped or otherwise formed with the desired brick design may have the advantage of lower cost and lighter weight as compared to a molded ceramic or other suitable material used in a molding process.

The combustion chamber enclosure 14 may also include a plurality of combustion air inlet openings 88, a light source opening 90, and an exhaust opening 92 to which an exhaust collar 94 may be secured to vent combustion gases out of the combustion chamber enclosure 14. The combustion air inlet openings 88 provide openings between a combustion air chamber 416 (discussed below) defined by the combustion air enclosure 18 and the combustion chamber enclosure 14 to provide combustion air for burning the fuel within the combustion chamber enclosure 14. Light source opening 90 is sized to receive the light assembly 34 and may also provide an air passage for combustion air to enter into the combustion chamber enclosure 14.

The top, bottom, and continuous panels 80, 82, 84 of combustion chamber enclosure 14 define a combustion chamber 98 and a front surface 96 of the combustion chamber enclosure 14 that is sized and configured to mount the glass panel 28 and provide a surface for creating an airtight seal between the glass panel 28, the combustion air enclosure 18, and the combustion chamber enclosure 14.

Combustion air enclosure 18 includes a plurality of panels, which when assembled together and secured to the combustion chamber enclosure 14 provide a combustion air chamber 416. The combustion air enclosure 18 includes a rear panel 400, first and second side panels 402, 404, a top panel 406 and a bottom panel 408. The side and rear panels 400, 402, may be well suited for formation from a single piece of material that is bent or otherwise formed to provide the various panels, although these panels may be separately formed and secured together and later secured to the top and bottom panels 106, 108 with welding, fasteners, or other suitable connection methods.

A combustion air collar 410 defining a combustion air opening 411 may be formed or otherwise secured in the top panel 406 or another panel of the combustion air enclosure 18 so as to provide a source of combustion air into the combustion air chamber 416. In this example embodiment, the fireplace assembly 10 includes a coaxial pipe 38 that facilitates combustion airflow through an outer pipe and exhaust airflow through a center exhaust pipe of the coaxial pipe 38. Other embodiments may include a co-lineal flue arrangement.

Combustion air enclosure 18 may also include a plurality of glass panel latches 412 secured adjacent to a front surface 418, and may further include a burner gas line opening 414 (discussed below) that is sized to receive the burner gas line 454 (discussed below) of the burner plate assembly 16.

Figure 10:
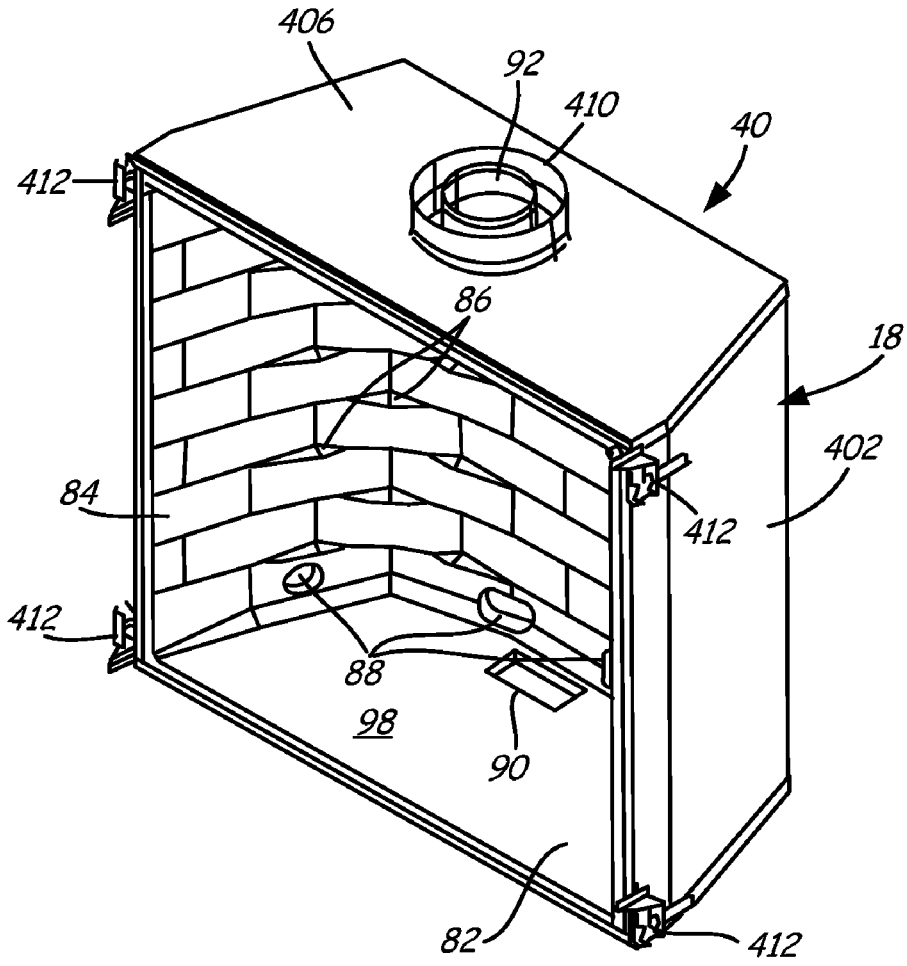
FIG. 10 is a front perspective view of a portion of the fireplace shown in FIG. 3 with the outer enclosure removed.

The combustion air enclosure 18 is secured to the combustion chamber enclosure 14 along the front surface 96 of the combustion chamber enclosure 14 and the front surface 418 of the combustion air enclosure 18 such that only a single gasket or other sealing structure is required to form an airtight seal between the enclosures 14, 18. The combined combustion chamber enclosure 18 and combustion air wrap 18 form a firebox assembly 40, as shown in FIG. 10.

Combustion air enclosure 18 is also configured so as to provide a complete jacket or wrap around the entire outer surface of the combustion chamber enclosure 14 (except around the front surface 96), thus providing an extensive combustion air chamber 416 that facilitates free flow of combustion air all around the panels of the combustion chamber enclosure 14. As a result of this configuration, a hole extending through any panel of the combustion chamber enclosure 14 provides an opening for intake of combustion air into the combustion chamber enclosure. Thus, combustion air can be provided at very specific locations within the combustion chamber enclosure to meet the specific needs of a particular burner plate assembly design. Also, when using a plurality of combustion air inlet openings 88 throughout the combustion chamber enclosure 14, the fireplace is much less susceptible to environmental changes such as high gusts of wind that would otherwise extinguish the fire within the combustion chamber enclosure 14. Furthermore, the movement of combustion air around the outer surface of the combustion chamber enclosure 14 helps to cool the combustion chamber enclosure 14 and provide a further insulating layer between the combustion chamber and the outer enclosure 12.

In other embodiments, the combustion air enclosure may extend around two or more of the combustion chamber enclosure panels. For example, the combustion air enclosure may extend around only the bottom and first and second side panels of the combustion chamber enclosure, or around only the first and second side and rear panels of the combustion chamber enclosure. Further, although the combustion air enclosure shown in the figures covers the entire outer surface of each of the panels of the combustion chamber enclosure, in other embodiments the combustion air enclosure may cover only portions of certain panels of the combustion chamber enclosure.

The burner plate assembly 16 includes a burner plate 420, a grate 422, mounting brackets 424, a pilot light 426 and a pilot light support 428. The mounting brackets 424 may extend through combustion air inlet openings 88 and be secured to the rear panel 400 of the combustion air enclosure 418 (see FIG. 9). The burner plate 420 may be made of a number of different materials including, for example, a ceramic material, metals or metal alloys. If the burner plate 420 is made from a ceramic material it may be advantageous to position the burner plate at an angle (as shown in FIG. 8) to help spread the flame across a top surface of the burner plate so as to enhance the look of the flame emanating from the burner plate. Positioning the burner plate 420 at an angle may also provide the advantage of raising a rear portion of an artificial set of logs sitting on grate 422 and burner plate 420 to provide a better view of the logs and the flames of the burner plate. Such an angled burner plate arrangement may be less advantageous for a metal or metal alloy burner because contact of the flame on the top surface of the burner plate may reduce the life of the burner plate.

The glass panel 28 includes a glass sheet 440 and a glass frame 442. Glass panel 28 is mounted to the combustion chamber enclosure 14 and combustion air enclosure 18 with the glass panel latches 412. Latches 412 each include a spring-biased connector that retains the glass panel against the front surface of combustion chamber enclosure 14. The use of spring-biased connectors may be particularly advantageous when unignited gas builds up in the combustion chamber enclosure 14 and then is ignited. The springs of the spring biased connectors would allow the glass panel to move away from the front surface of the combustion chamber enclosure to relieve the pressure resulting form the ignition of the built-up gas, thereby breaking the seal otherwise formed there between to permit the pressure from the ignited gas to exit the combustion chamber enclosure 14 rather than breaking the glass.

Typically, mounting glass panel 28 with glass panel latches 412 provides an airtight seal of the combustion chamber 98 and the combustion air chamber 416 with exception of the openings 92, 411 for exhausting and providing combustion air, respectively. Glass frame 442 may include a mounting bracket 444 that supports the hanging wire mesh 36, which wire mesh is common for protecting the user from harmful touching of the glass sheet 440 when the glass panel 28 is heated.

Figure 7:
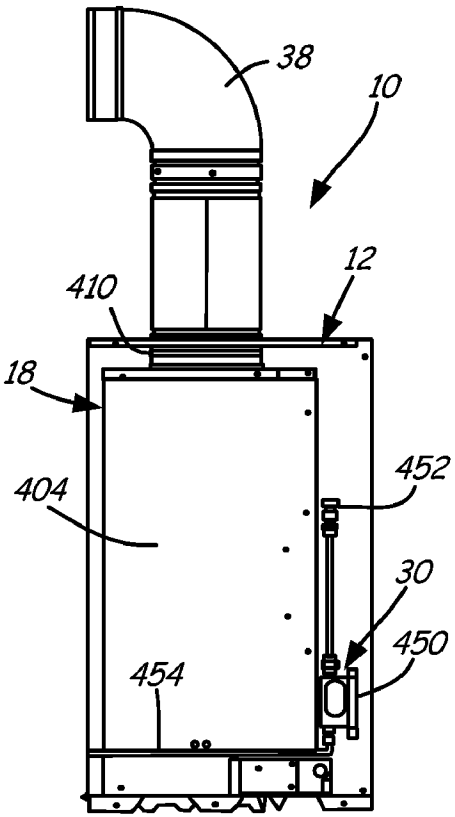
FIG. 7 is a side plan view of the fireplace shown in FIG. 3 with a side panel of the outer enclosure removed.
Figure 6:
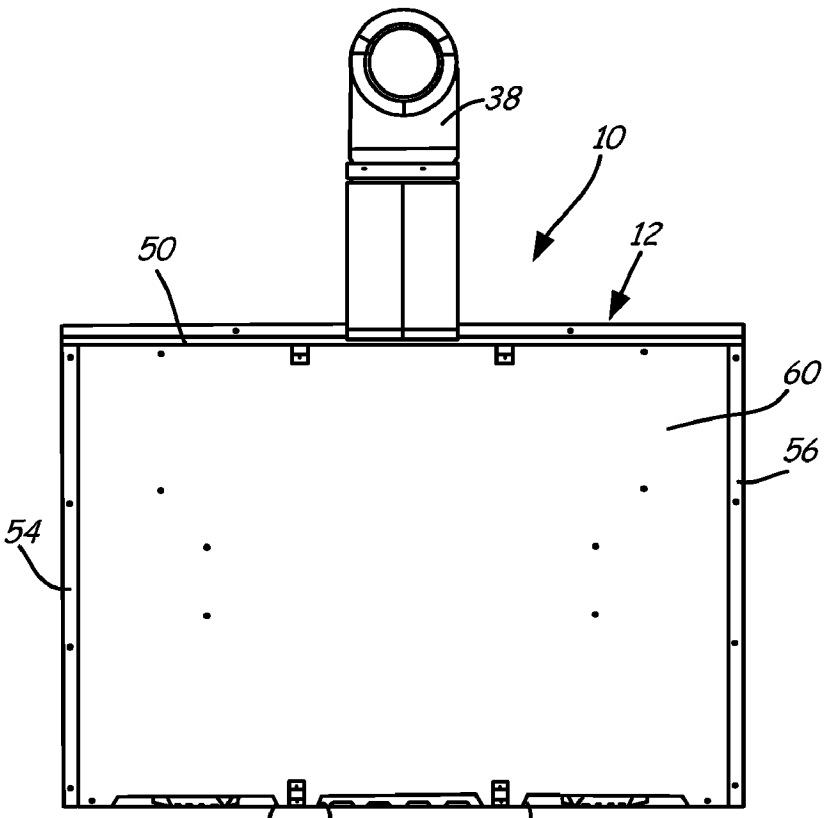
FIG. 6 is a rear plan view of the fireplace shown in FIG. 3.

Referring now to FIGS. 7 and 9, the gas valve assembly 30 is shown mounted within outer enclosure 12. Gas valve assembly 30 includes a valve 450, a gas inlet supply 452, and a gas burner supply 454. As opposed the orientation of the gas valve assembly of most known fireplace assemblies, gas valve assembly 30 is positioned between the outer enclosure 12 and a side surface of continuous panel 84 of the combustion chamber enclosure 14, rather than beneath the bottom panel 82 of combustion chamber enclosure 14. When the assembled combustion chamber enclosure 14 and combustion air enclosure 18 are mounted within outer enclosure 12, there is a space provided between front surfaces 98, 418 of the combustion chamber enclosure 14 and combustion air enclosure 18 and the front panel 58 of the outer enclosure 12. This space provides an access space for the mounted gas valve assembly 30 as well as to the control unit assembly 32, which control assembly includes a control module 460, a wire harness 462 and electrical junction box 464. This access space may be covered by the first and second removable panels 20, 22 so as to hide the gas valve assembly 30 and control unit assembly 32 from view.

In other embodiments, some components of the gas valve assembly 30 and control unit assembly 32 may be positioned at other locations within outer enclosure 12 besides beneath the bottom panel 82 or between the continuous panel 84 and outer enclosure 12, or may be positioned outside the outer enclosure in relative close proximity to the fireplace assembly 10. In yet further embodiments, some components of the gas valve assembly and other fireplace controls may be positioned at remote locations, for example, in an adjacent room to where the fireplace assembly resides.

The valve assembly 30 and control unit assembly 32 may be generally referred to as "controls" for the fireplace assembly. Other example features of a fireplace assembly that may also be considered part of the fireplace controls are switches, dials, computer chips and microprocessors, sensors, wiring, and meters. These controls may be used to control accessories associated with the fireplace, such as, for example, lights, blowers (e.g., circulating fan), artificial displays, sounds, etc. In some embodiments, some or all of the fireplace controls may be positioned outside of the outer enclosure 12, or may be positioned under the firebox 40 either inside or outside of the outer enclosure 12.

Panels 20, 22 are removably mounted in place between glass panel 28 and front panel 58 of the outer enclosure 12, and include a brick design that corresponds to the brick design of continuous panel 84. Preferably, the design formed on panels 20, 22 will substantially match with whatever design is included within the combustion chamber enclosure 14 so as to give the appearance of a continuous side wall even though the glass panel 28 is positioned between the removable panels 20, 22 and continuous side panel 84 of the combustion chamber enclosure 14. The ash lip panel 26 is also removable and is configured to cover a lower portion of glass frame 442 such that glass frame 442 is substantially covered by panels 20, 22, 26. The removable nature of panels 20, 22, 26 is also advantageous for use with the spring biased glass panel latches 412, which permit the glass panel to move away from the combustion chamber enclosure. A further upper panel (not shown) may also be included in some embodiments to cover a top portion of glass frame 442.

The light assembly 34 includes a light box 470, a light bulb 472 and a color film 474 positioned within light source opening 90 in combustion chamber enclosure 14. Light from light bulb 472 is projected upward within combustion chamber 98 to enhance the light of the actual flame from burner plate assembly 16 with the combustion chamber 98, and provides additional shadowing within combustion chamber 98 along the brick design ledges 86.

Figure 5:
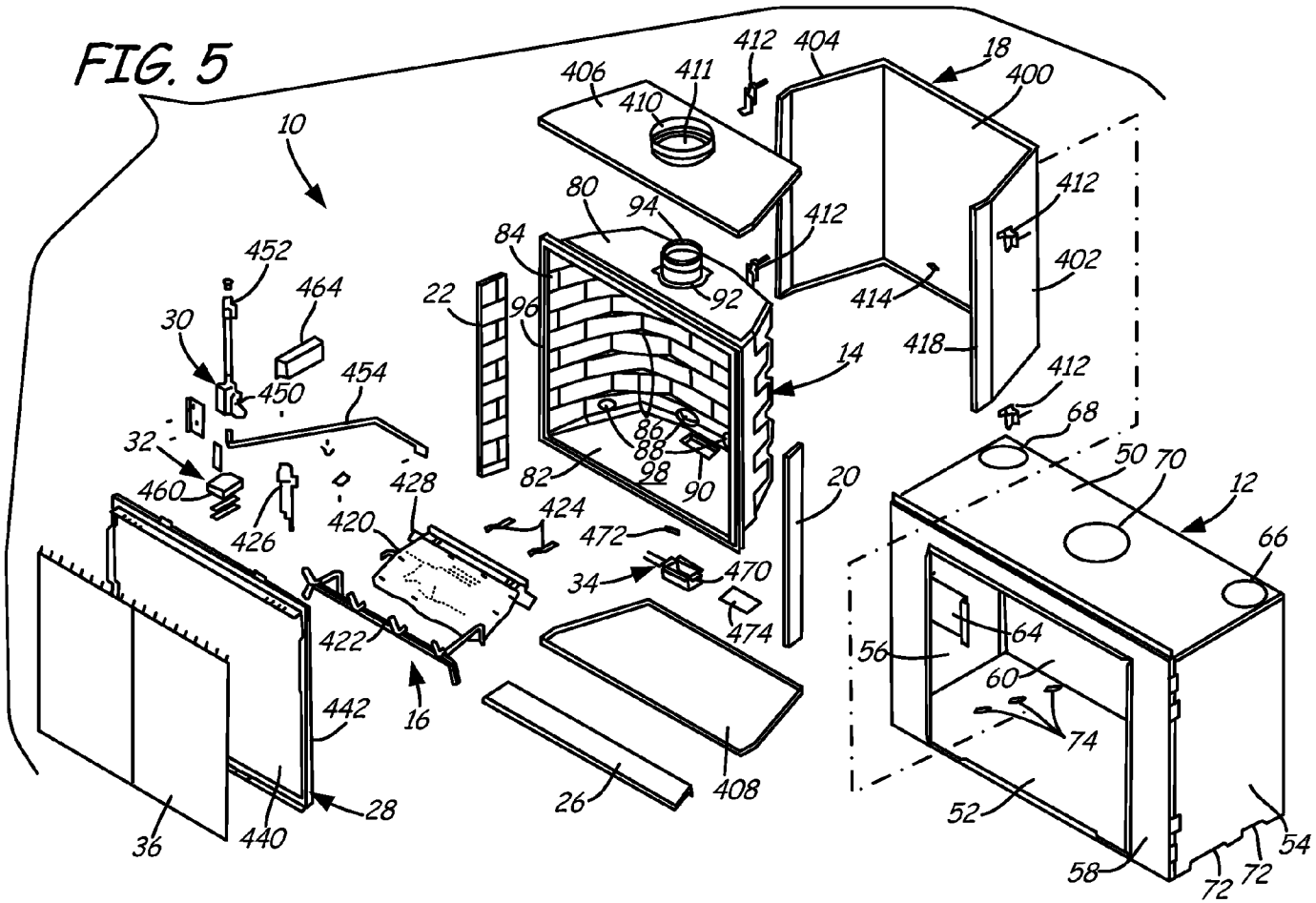
FIG. 5 is an exploded front perspective view of the fireplace shown in FIG. 3.

For example and without limitation, light from light bulb 472 can be projected onto the lattice structure formed by the plurality of ledges 86 in continuous side panel 84 (see FIGS. 3-5). Reflection of the light off of the lattice structure can create an aesthetically pleasing visual arrangement.

The light of light bulb 472 may be changed in color using a color film 474 that includes, for example, Kapton film or tape having an orange, yellow, or amber color. In other embodiments, light assembly 34 may include additional lights positioned at other locations around or adjacent to combustion chamber enclosure 14 so as to provide additional light within combustion chamber 98 as desired.

Additional details regarding fireplace assembly 10 can be found in U.S. patent application Ser. No. 10/718,053, entitled "Reduced Clearance Gas Fireplace," filed on even date herewith, the entirety of which is hereby incorporated by reference.

The present invention should not be considered limited to the particular examples or materials described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

What is claimed is:

1. A fireplace, comprising:

an enclosure defining a bottom back portion and including a plurality of panels, the plurality of panels defining a combustion chamber and including a lower panel and a rear panel;

a backlighting system positioned at the bottom back portion of the enclosure and including at least one light source adapted to shine light directly upon the rear panel of the fireplace;

a burner adapted for combusting gases to generate flames in the combustion chamber;

a sensor configured to sense flames generated by the burner in the combustion chamber; and a control system in electrical communication with the sensor and the backlighting system, the control system configured to cause the backlighting system to shine light on the rear panel when the burner is not generating flames as sensed by the sensor.

2. The fireplace of claim 1, wherein the lower panel has a back portion proximate the rear wall, the back portion of the lower panel forming an opening in the enclosure, and further wherein the light source is positioned at least partially below the lower panel so that the light from the light source shines through the opening in the back portion of the lower panel and into the combustion chamber.

3. The fireplace of claim 1, wherein the enclosure has a front opening opposite the rear panel, and further wherein the backlighting system is positioned within the enclosure so as not to be visible through the front opening of the enclosure.

4. The fireplace of claim 1, wherein at least a portion of the rear panel of the enclosure defines a lattice structure, and wherein the light source is configured to shine the light on the lattice structure.

5. The fireplace of claim 1, wherein the backlighting system includes more than one light source positioned at the back portion of the enclosure.

6. The fireplace of claim 1, wherein the light source is configured to withstand high temperature generated by the fireplace.

7. The fireplace of claim 1, wherein the light source includes a halogen bulb and a ceramic socket.

8. The fireplace of claim 1, wherein the control system is configured to turn on the light source when a natural fire is being simulated within the fireplace.

9. The fireplace of claim 1, wherein the sensor is a photocell module adapted to sense light from the flames in the enclosure and wherein the control system turns the backlighting system on and off depending on an amount of light in the enclosure of the fireplace.

10. The fireplace of claim 1, wherein the sensor is a photocell module and wherein the control system is further configured to turn the backlighting system on and off depending on an amount of light outside of the fireplace.

11. The fireplace of claim 1, wherein the control system further includes a manual control that is manually controlled by a user of the fireplace.

12. A fireplace, comprising:

an enclosure including a plurality of panels, the plurality of panels defining a combustion chamber and including a rear panel and a side panel a burner connected to a source of combustible gas, the burner adapted to generate flames in the combustion chamber;

a backlighting system positioned to shine light directly upon the rear panel of the fireplace;

a sensor configured to sense flames in the fireplace; and a control system in electrical communication with the backlighting system and the sensor;

wherein the control system is configured to cause the backlighting system to stop shining light on the rear panel when flames are being generated in the combustion chamber as sensed by the sensor.

13. The fireplace of claim 12, wherein the sensor is a photocell module coupled to the control system.

14. The fireplace of claim 12, further comprising a photocell module coupled to the backlighting system, wherein the photocell module turns the backlighting system on and off depending on an amount of light outside of the fireplace.

15. A fireplace, comprising:

an enclosure defining a combustion chamber and an open front, the enclosure including at least a lower panel, two side panels and a back panel opposite the open front;

a burner positioned adjacent to the lower panel, the burner adapted to combust gases to generate heat in the combustion chamber;

a backlighting system positioned to shine light directly upon components of the fireplace including at least the back panel, a sensor for sensing a temperature of the fireplace;

a control system in electrical communication with the sensor and the backlighting system, the control system configured to cause the backlighting system to provide aesthetic lighting on at least the back panel when the burner is not generating heat in the combustion chamber as sensed by the sensor.

16. The fireplace of claim 15, wherein the lower panel has a back portion proximate the back panel and the back portion of the lower panel defines an opening, and further wherein the light source is positioned at least partially below the lower panel so that the light from the light source shines through the opening in the back portion of the lower panel into the combustion chamber.

17. The fireplace of claim 15, wherein at least a portion of the back panel of the enclosure defines a lattice structure, and wherein the light source is positioned to shine the light on the lattice structure.

18. The fireplace of claim 15, wherein the light source is positioned adjacent to the burner of the fireplace.

19. A method of providing backlighting for a fireplace, comprising:

providing an enclosure defining a combustion chamber and an open front, the enclosure including at least a lower panel, two side panels, and a back panel, the side panels and the back panel forming a plurality of ledges;

providing a log set positioned in the enclosure;

positioning a backlighting system including a light source in a back portion of the enclosure behind the log set;

generating flames in the combustion chamber;

sensing light from the flames generated in the combustion chamber using a sensor; and shining light directly on the plurality of ledges with the light source upon sensing that light from the flames is not being generated in the combustion chamber.

20. The method of claim 19, wherein the step of positioning the backlighting system further comprises:

defining an aperture in the lower panel of the enclosure; and positioning the light source so that the light shines through the aperture and into the enclosure.

21. The method of claim 19, wherein the step of providing the enclosure further comprises:

forming a lattice structure on at least a portion of the back panel of the enclosure; and positioning the light source to shine the light on the lattice structure.

22. The method of claim 19, further comprising modulating the light source of the backlighting system depending on a state of a flame generated in the combustion chamber.

23. The method of claim 19, wherein the step of positioning the backlighting system further comprises positioning the backlighting system adjacent to a burner of the fireplace.

* * * * *